United States Patent [19]

Titzer et al.

[11] Patent Number: 5,062,288

[45] Date of Patent: Nov. 5, 1991

[54] METHOD AND APPARATUS FOR FORMING BENDS IN A TUBE

[75] Inventors: Keith Titzer, Evansville; Charlie Oran, Wadesville; Richard Reich, Evansville; Gary Gann, Evansville; William O. Toy, Jr., Evansville; Jerry Lamb, Evansville; Chris Brack, Evansville; Lloyd Comer, Evansville; Dan Libbert, Evansville; Don Masterson, Evansville; Jerry Shekell, Evansville; Don Deig, Evansville; Kenneth Butler, Evansville; Earl Roehm, Evansville, all of Ind.

[73] Assignee: Indiana Tube Corporation, Evansville, Ind.

[21] Appl. No.: 625,655

[22] Filed: Dec. 13, 1990

[51] Int. Cl.[5] ..... B21D 11/07

[52] U.S. Cl. ..... 72/383; 72/384

[58] Field of Search ..... 72/383, 385, 384, 386; 140/90, 105

[56] References Cited

U.S. PATENT DOCUMENTS

| | | | |
|---|---|---|---|
| 3,722,254 | 3/1973 | Katogir | 72/383 |
| 4,753,098 | 6/1988 | Roehm et al. | 72/383 |

FOREIGN PATENT DOCUMENTS

| | | | |
|---|---|---|---|
| 0048427 | 4/1980 | Japan | 72/385 |
| 63149022 | 4/1980 | Japan . | |
| 0095821 | 4/1989 | Japan | 72/383 |

*Primary Examiner*—David Jones

*Attorney, Agent, or Firm*—Larson & Taylor

[57] ABSTRACT

A method and apparatus is provided for forming bends in a tube. A set of bend forming elements are mounted on each of a pair of parallel guideways. Each set of bend forming elements are interconnected by lazy tongs and a motor is provided to drive each set of bend forming elements along the guideways so that each set of bend forming elements may be moved together or separated while maintaining equal spacing between the elements. When a straight tube is placed between the sets of bend forming elements and the bend forming elements are driven together while the guideways simultaneously are driven apart, bends are formed in the tube to form the tube into a serpentine configuration. The bend forming elements have at least two different curvatures on their external surfaces so that the bends in the tube are formed in two stages with each of the different curvatures being sequentially operative to form the final bends in the tube.

7 Claims, 4 Drawing Sheets

METHOD AND APPARATUS FOR FORMING BENDS IN A TUBE

The present invention relates to a method and apparatus for forming a straight tube or rod into a serpentine configuration wherein two stages of bending are utilized to form more perfect 180° bends in the tube.

BACKGROUND OF THE INVENTION

In the prior art there are disclosed many types of devices utilized for forming a straight tube into a serpentine configuration for use, for example, as a refrigerator coil. U.S. Pat. No. 4,753,098 issued June 28, 1988 and assigned to the assignee of the present application discloses a tube forming apparatus utilizing bending rollers which are interconnected by lazy tong linkages so that each set of a pair of bending rollers may be simultaneously brought together while one set of rollers is separated from the other set of rollers. While the method and apparatus disclosed in U.S. Pat. No. 4,753,098 has been effective in producing refrigerator coils, it has been found that the apparatus disclosed in the aforesaid patent could not provide sufficient tension to form small radius bends in the tube.

There are other prior art references which disclose various types of mechanisms for bending tubes. Japanese patent 63-149022 issued June 21, 1988 discloses sets of bend forming elements slidably mounted on guide rails wherein the guide rails are moved apart as the sets of bend forming elements are moved together so as to form a tube into a serpentine configuration. The Katogir U.S. Pat. No. 3,722,254 issued Mar. 27, 1973 discloses a tube bending apparatus including a series of material forming heads which are movable relative to each other and movable from retracted to extended positions. While the aforesaid patents disclose equipments capable of forming tubes into a serpentine configuration, the prior art does not provide the particular combination of elements disclosed in the present invention which operates to produce small radius bends in tubes.

SUMMARY OF THE INVENTION

According to the present invention there is provided a method and apparatus for forming bends in a tube which includes a pair of parallel guide rails, one of the guide rails being laterally movable with respect to the other guide rail. A plurality of bend forming elements are rotatably mounted on supporting blocks which are slidable on the guide rails. Lazy tong linkages interconnect the supporting blocks so that when a motor drives the blocks along the length of the guideway the spacing between all the supporting blocks is maintained equidistant. Thus, when a straight tube is positioned in the apparatus to have bends formed thereon, the set of tube bending elements mounted on support blocks slidable on one guideway are positioned on on side of the tube and the set of tube bending elements mounted on support blocks on the other guideway are positioned on the other side of the tube. The tube is clamped at the ends and the movable guide rail moves laterally away from the other guide rail while the support blocks are simultaneously moved together. By this series of steps the straight tube is formed into a serpentine configuration.

The external surface of the tube bending elements are formed with sections having two different radii of curvature. The bend forming steps include first shaping the tube bends elements utilizing that portion of the external surface of the elements having the greater radius of curvature, separating the supporting blocks slightly so as to release the elements from engagement with the tube, rotating the bend forming elements so that the portions of the external surface of the elements having a smaller radius of curvature are positioned to engage the tube and subsequently bringing the supporting blocks together to reshape the tube bends into a smaller radius of curvature. By utilizing a two stage bending operation it has been found that tube bends of small radius may be formed with a greater degree of accuracy.

An object of the present invention is to provide a method and apparatus for forming tubes into a serpentine configuration with a high degree of accuracy.

Another object of the present invention is to provide in a tube bending apparatus tube bending elements having external surfaces with two different radii of curvature and forming the tube bends by sequentially utilizing each of the radii of curvature to form the tube bends.

Other objects and many of the attendant advantages of the present invention will become more readily apparent upon consideration of the detailed specification in connection with the accompanying drawings wherein:

Figure 3:
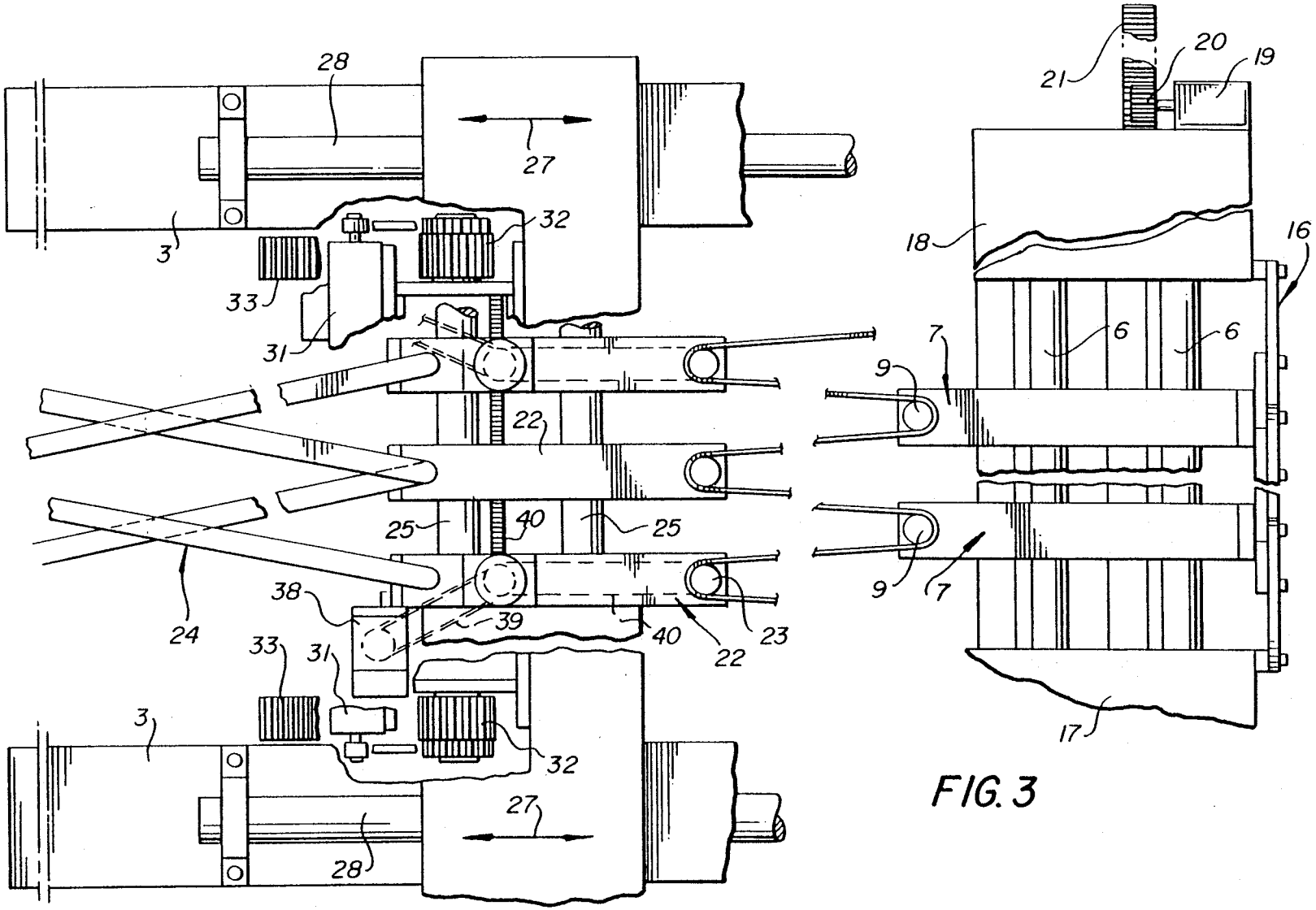
FIG. 3 is a plan view similar to FIG. 2 showing the bend forming members positioned with the bends formed in the tube.

As referred to hereinbefore, the present invention is an improvement on assignee's prior U.S. Pat. No. 4,753,098 and the disclosure of that patent is incorporated by reference herein. As shown in U.S. Pat. No. 4,753,098 there is provided two sets of bending rollers, one set being disposed on each side of a center line. Each set of bending rollers are interconnected by a lazy tong linkage which is mounted on a carriage frame. A straight tube which is to be formed into a serpentine configuration is placed along the center line of the apparatus with the bending rollers in one set being disposed on one side of the tube and the bending rollers on the other set being disposed o the opposite side of the tube. As the sets of bending rollers are moved together along the carriage frame, the rollers on opposite sides of the tube draw the tube laterally from the straight line position to form 180° bends in the tube around each bending roller as shown in FIG. 3 of U.S. Pat. No. 4,753,098.

The present invention provides an apparatus in which the carriage frame structures shown in U.S. Pat. No. 4,753,098 which support the lazy tong linkages are eliminated. Further, instead of moving both sets of bending rollers laterally from the center line as disclosed in assignee's prior patent, according to the present invention only one set of bending rollers is moved laterally by means of a separate drive mechanism. The other set of bending rollers are moved on a track along a straight line parallel to the longitudinal axis of the straight tube to be formed into a serpentine configuration.

Figure 1:
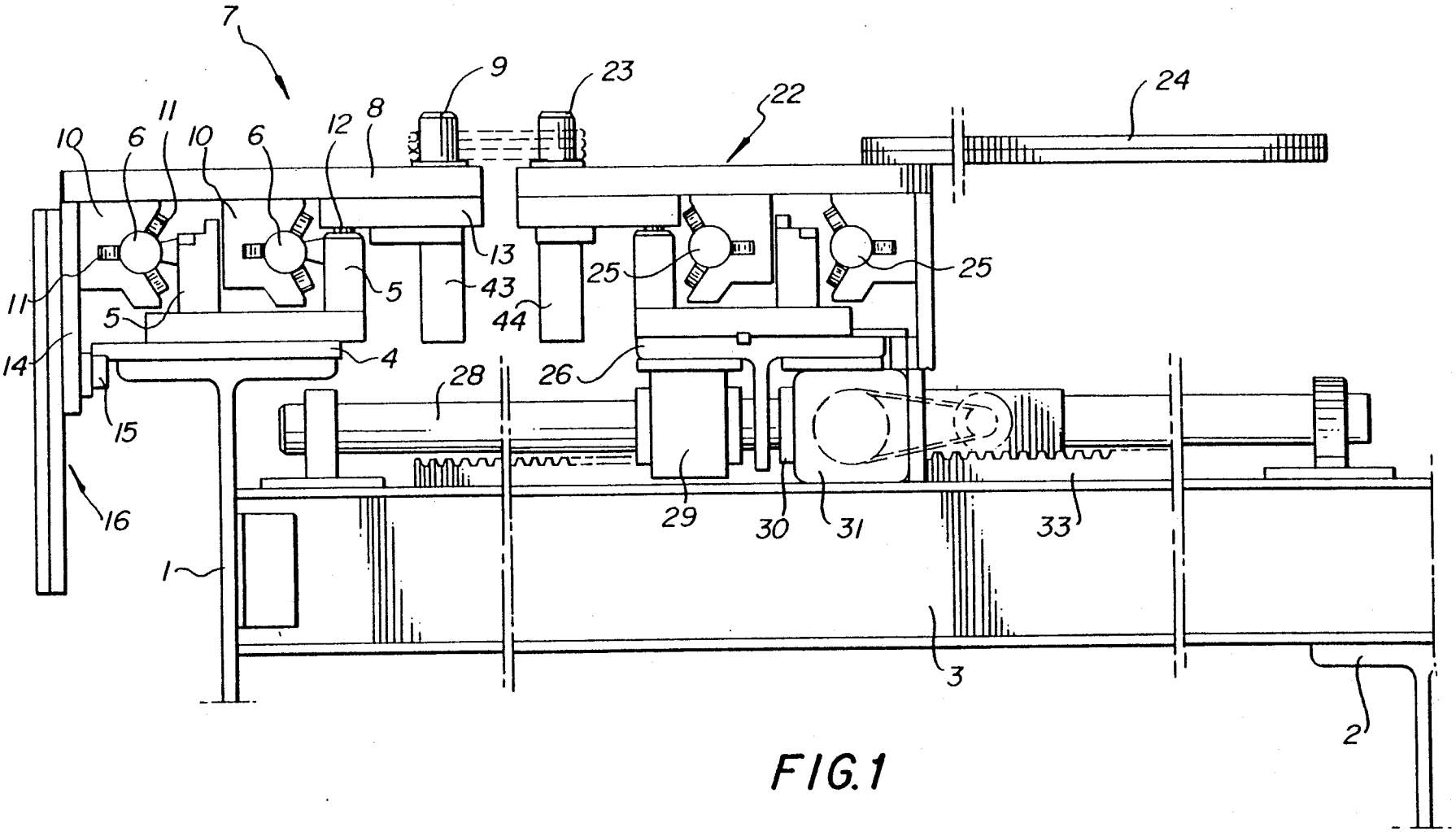
FIG. 1 is a side elevational view of the bend forming apparatus.

Referring now more specifically to FIG. 1 there are shown a pair of I beams 1 and 2 which support the tube bending apparatus and extend the entire longitudinal length of the apparatus. A plurality of cross beams 3 are provided on four foot centers, one beam being located at each end of the apparatus, as shown in FIGS. 1 and 3. The crossbeams 3 are secured to the top face of I beam 2 and to the side support surface of the I beam 1.

Mounted on the upper face of I beam 1 is a guide shaft support block 4 which extends the length of I beam 1 and has rigidly affixed to the upper surface thereof a pair of guide shaft retaining members 5. Secured to each of retainer members 5 is a guide shaft 6. The guide shafts 6 extend the entire length of the apparatus and support the tube bending elements in their longitudinal movement on the shafts. Each of the tube bending elements comprise a support plate 8 having a tube bending roller 9 rotatably mounted on the upper surface of one end of the plate 8. Each of the support plates 8 is provided with a pair of roller bearing retaining blocks 10 secured to the bottom surface of the plate 8 and the roller bearings 11 are rotatable on the retaining blocks 10 and engage the surface of the guide shafts 6. The support plate 8 is further supported by roller bearing 12 mounted in a retainer block 13 beneath the tube bending roller 9. An arm 14 fixed to the opposite end of the support plate 8 extends downwardly and has a roller bearing 15 which engages the undersurface of guide shaft support 4. It can be seen that the tube bending elements 7 are retained on the fixed guide shafts 6 for sliding movement along the longitudinal axis of the guide shafts 6.

In prior U.S. Pat. No. 4,753,098 the tube bending elements are shown as being interconnected by a lazy tong linkage so that the spacing between the tube bending elements will be maintained equidistant as the tube bending elements are moved together or apart. In assignee's prior patent the lazy tong linkage extends in the same horizontal plane as the tube bending elements. In the present invention the lazy tong linkage interconnecting the tube bending elements 7 at the front side of the apparatus are shown generally at 16 in FIG. 1 and extend vertically with respect to the horizontal plane of the tube bending elements 7. The construction and operation of the lazy tong linkage 16 is identical to that shown in prior U.S. Pat. No. 4,753,098 except that in the present invention one end of the linkage is stationary. Referring to FIG. 3 which shows in top plan view the tube bending elements 7 slidable on guide shafts 6 it can be seen that one end of the lazy tong linkage 16 is pivotally mounted on a stationary block 17. The opposite end of the lazy tong linkage 16 is pivotally mounted on a drive block 18 which is slidable along the guide shaft 6 by means of roller bearings similar to the roller bearings supporting the tube bending elements 7. A motor 19 is mounted on the drive block 18 and has a pinion gear 20 mounted on the drive shaft which engages a rack 21. Thus, upon activation of the motor 19 the plurality of tube bending elements 7 are driven together against the stationary block 17 or driven apart with the lazy tong linkage 16 maintaining the spacing between the tube bending elements 7 equidistant during movement along the guide shafts 6.

The rear set of tube bending elements 22 are generally similar in structure and operation to the forward set of elements 7. One end of each of the elements is provided with a rotatable tube bending roller 23 and the opposite end of the elements 22 are pivotally mounted to lazy tong linkage 24. As shown in FIGS. 1 and 3 the lazy tong linkage 24 is disposed in the same horizontal plane as the tube bending elements 22 and functions to maintain equidistant spacing between the tube bending elements 22 as the elements are moved together or apart.

The tube bending elements 22 are mounted for sliding movement on guide shafts 25 in a manner identical to the mounting of tube bending elements 7 on guide shafts 6. The lazy tong linkage 24 is fixed at the same end as the lazy tong linkage 16. The opposite end of the linkage 24 and tube bending elements 22 is provided with a drive mechanism as shown in FIG. 3 comprising motor 38 which drives belt 39 and a pinion gear (not shown) engaging rack 40. This drive mechanism is similar to the drive mechanism 19, 20 and 21 for the bending elements 7. As shown in FIG. 1 there is provided a guide shaft support 26 to support the guide shafts 25 and support 26 is mounted so as to be movable along the length of cross beams 3 as shown generally by the arrows 27 in FIG. 3. Mounted on the upper face of cross bars 3 are shafts 28. The guide shaft support 26 extends between the cross bars 3 and is slidably supported on the shafts 28 by means of bearings 29 and 30. A motor 31 drives a pinion gear 32 which engages a rack 33 fixed to the upper surfaces of cross beams 3. Thus, as the tube bending elements 22 are drawn together along the guide shafts 25, the tube bending elements are simultaneously moved laterally away from the tube bending elements 7 as the supporting structure for elements 22 are driven outwardly along shafts 28.

Figure 2:
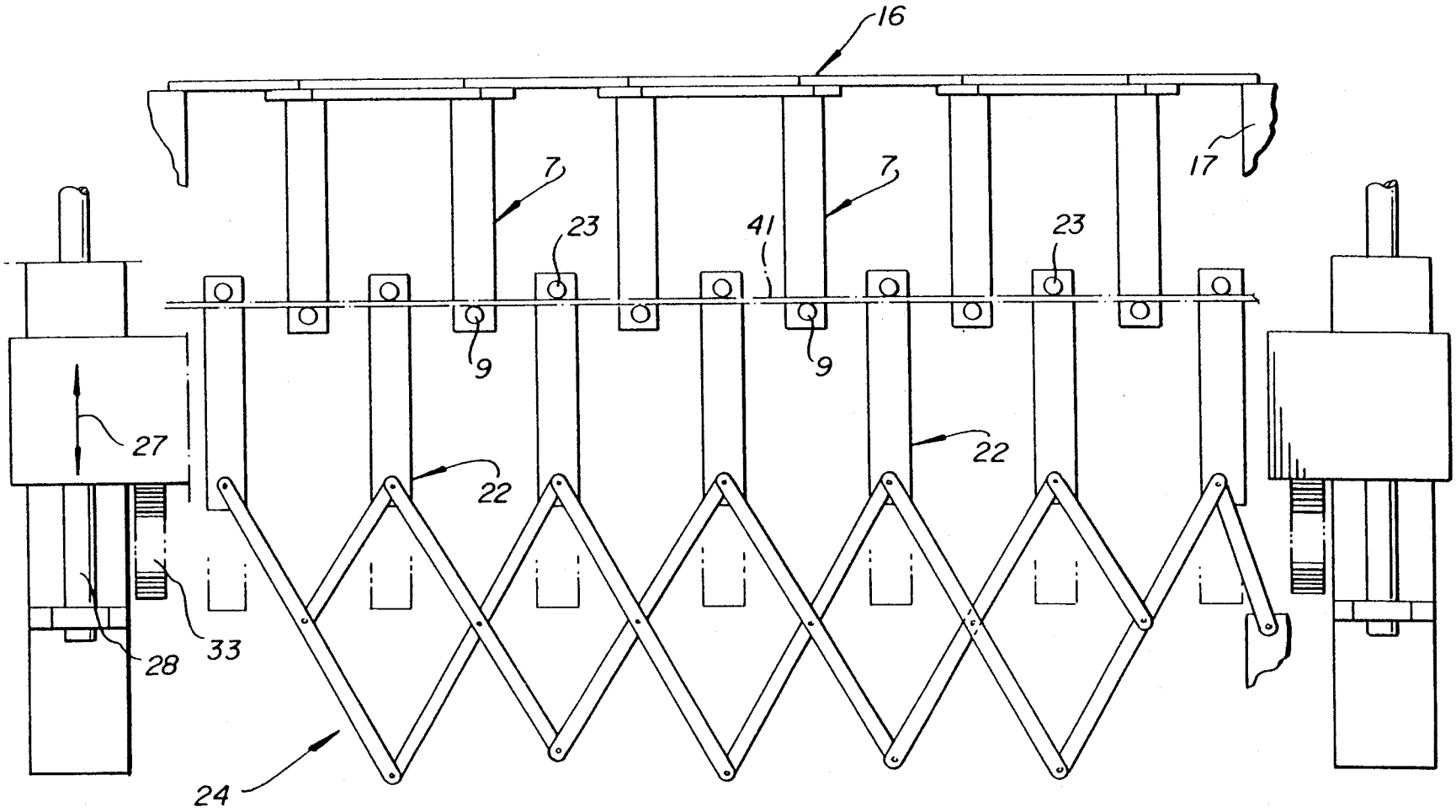
FIG. 2 is a plan view of the bend forming members with interconnecting linkage with the bend forming members positioned to bend a straight tube.

The rollers 9 mounted on the tube bending elements 7 and the rollers 23 mounted on tube bending elements 22 are shown in FIGS. 1–3 as being cylindrical in shape for purposes of simplicity. The rollers in fact are shaped with two different radii of curvature. It was found when forming tubes with the bending apparatus disclosed in U.S. Pat. No. 4,753,098 that it was difficult to form small radius bends in the tube. In order to overcome this problem the present invention is provided with rotatable bending rollers having a portion of the periphery formed with a relatively large radius of curvature to provide a first stage of tube bending and a second portion of the periphery of the rollers having a smaller radius of curvature to provide a final stage of tube bending.

Figure 4:
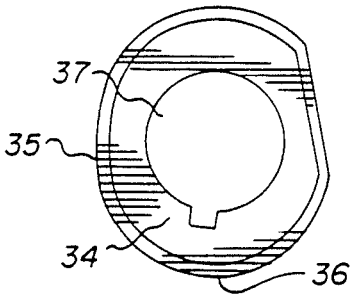
FIG. 4 is a plan view of a tube bending roller and, FIGS. 5 to 8 disclose diagrammatically sequentially the positions of the tube bending elements as the bends in the tube are formed.

In FIG. 4 there is shown a plan view of a tube bending roller 34 to be used on both tube bending elements 7 and tube bending elements 22. The roller 34 has a portion of the periphery thereof provided with a relatively large radius of curvature 35 and a second portion of the periphery provided with a smaller radius of curvature 36. A central drive shaft 37 is keyed to the roller 34. In FIG. 1 there is shown a motor 43 mounted on tube bending arm 8 which rotates tube bending roller 9. There is also shown a motor 44 on tube bending arm 22 which rotates tube bending roller 23. Similar mechanisms are provided for all rollers on both tube bending elements 22 and tube bending elements 7.

Figure 5:
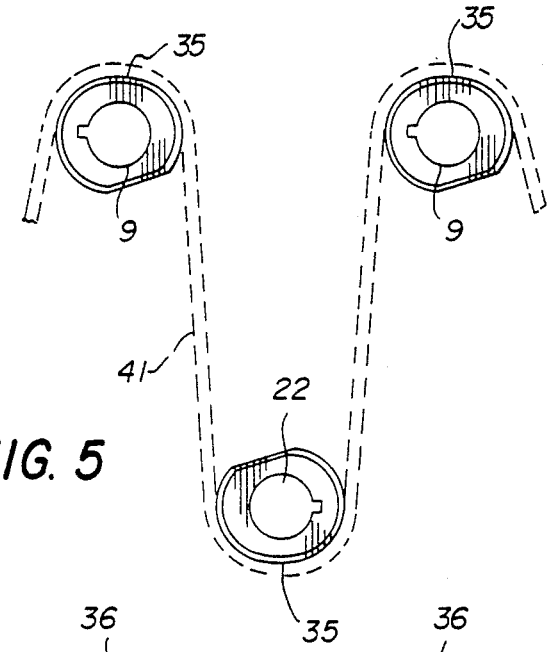
Figure 6:
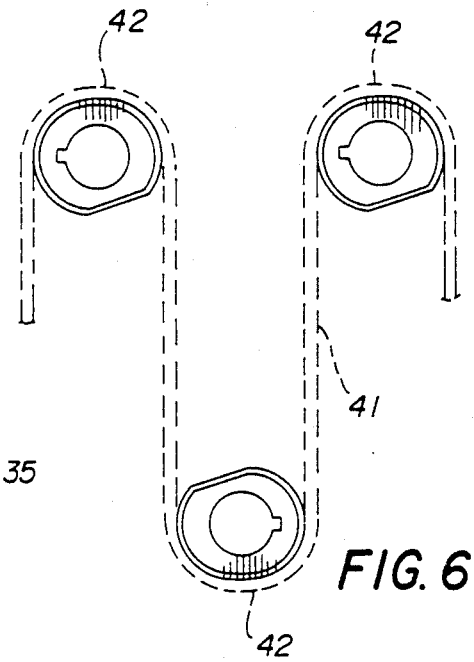
Figure 7:
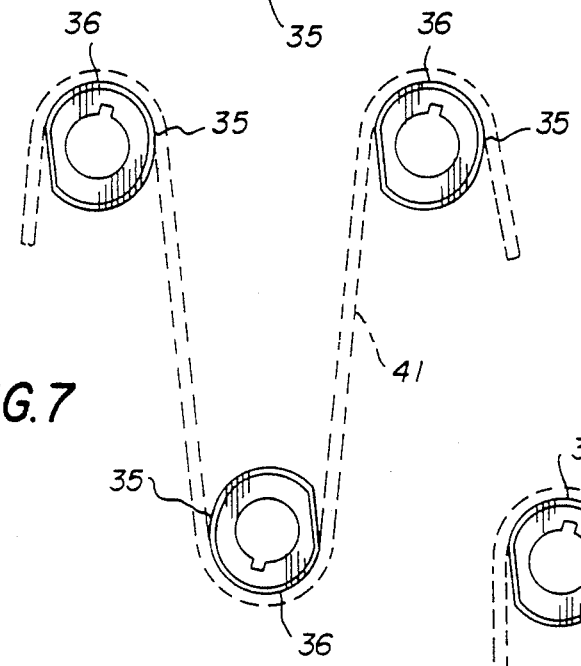
Figure 8:
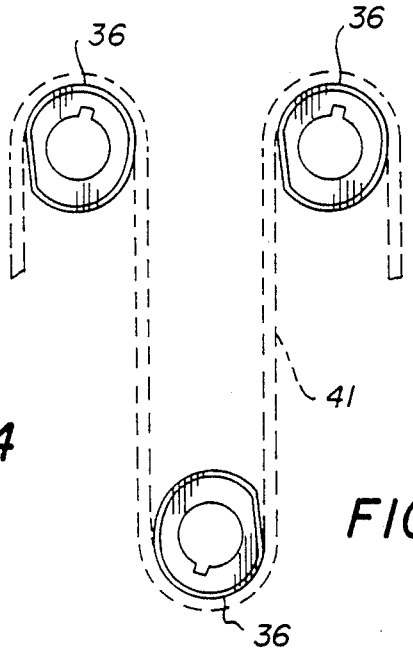

In FIGS. 5 to 8 inclusive there is shown the sequence in which the bends are formed in a tube. In FIG. 5 the tube bending rollers 9 and 22 ar positioned with the portions 35 of the rollers having the larger radius of curvature in contact with the tube so that when the tube bending elements 7 and 22 are brought together tightly as shown in FIG. 6 wider bends 42 are formed in tube 41. Subsequently the tube bending elements 7 and 22 are driven slightly apart as shown in FIG. 7 and the rollers are rotated so that the portions 36 of the rollers having the smaller radius of curvature are brought into contact with the surface of the tube 41. The tube bending elements 7 and 22 are then driven together again as shown in FIG. 8 to form the final smaller radius 180° bends in the tube.

A hydraulic piston and toggles (not shown) extending between the fixed I beam 1 and the guide support shaft 26 may be provided to drive the rear set of tube bending elements 22 to the final position shown in FIG. 8.

The present invention provides a method and apparatus for forming straight tubes into a serpentine configuration. As seen in FIG. 2 when the tube bending elements 7 and 22 are in the extended position the tube bending rollers 9 on elements 7 are positioned behind the tube bending rollers 23 on the elements 22. The slot formed between the rollers 9 and 23 receives a straight tube 41 which may be fed to the apparatus from a storage bin above. When the tube is in place the tube bending elements 7 and 22 are brought together towards the fixed end 17. The lazy tongs 16 and 24 maintain equidistant spacing between the tube bending elements 7 and 2 as they are brought together. Simultaneously as the tube bending elements 7 and 22 are brought together, the rear set of elements 22 are driven laterally away from the tube bending elements 7 so as to gradually transform the straight tube 41 into a serpentine configuration. The sequence of steps shown in FIGS. 5 to 8 completes the shaping of the tube.

Obviously many modifications and variations of the present invention are possible in light of the foregoing teachings.

What is claimed as new and is desired to be secured by Letters Patent is:

1. A method for forming a tube into a serpentine configuration comprising the steps of locating at least one straight tube lengthwise between spaced bend forming elements having predetermined curvatures thereon with adjacent bend forming elements being disposed on opposite sides of the tube, clamping the ends of the tube, bringing the spaced bend forming elements together with lazy tong linkages along a longitudinal line parallel to the longitudinal center line of the straight tube and simultaneously drawing one set of alternate bend forming elements disposed on one side of the straight tube along a line extending normally with respect to the longitudinal center line of the straight tube to form the tube into a serpentine configuration, and subsequently separating the tube forming elements and changing the curvature on the bend forming elements and bringing the bend forming elements together again to reshape the bends formed in the tube.

2. A method for forming a tube into a serpentine configuration comprising the steps of locating a tube between a pair of sets of spaced bend forming elements having predetermined curvatures thereon, one set of bend forming elements being disposed on one side of the tube and the other set of bend forming elements being disposed on the other side of the tube, clamping the tube in place, bringing both sets of spaced bend forming elements together along longitudinal lines parallel to the longitudinal center line of the straight tube and simultaneously drawing one set of bend forming elements outwardly on a line extending normally with respect to the longitudinal center line of the straight tube to form the tube into a serpentine configuration, separating the sets of bend forming elements slightly, changing the curvature on the bend forming elements and bringing the bend forming elements together again to reshape the bends formed in the tube.

3. A method according to claim 2 wherein the outer surface of each bend forming element has more than one radius of curvature and the curvature on the bend forming elements is changed by rotating the bend forming elements.

4. A method according to claim 2 including during the step of bringing the bend forming elements together maintaining the bend forming elements in equal spaced relation by lazy tongs interconnecting the bend forming elements.

5. An apparatus for forming bends in a tube comprising a base, guide rails mounted on said base, first guide rails being fixed on said base and extending longitudinally on said base, second guide rails extending parallel to said first guide rails and mounted on said base to move towards and away from said first guide rails, a plurality of bend forming support blocks mounted on said guide rails and slidable thereon, lazy tong linkages interconnecting said bend forming support blocks for maintaining said bend forming support blocks in equal spaced relationship, bend forming elements mounted on said support blocks, each of said bend forming elements having an external surface which includes more than one radius of curvature, means for locating each radius of curvature in an operative position, means for driving the bend forming support blocks on said first and second guide rails together and apart and means for simultaneously driving said second guide rails apart and together with respect to the first guide rails.

6. An apparatus according to claim 5 wherein said means for locating each radius of curvature in an operative position includes motor means for rotating said bend forming elements.

7. An apparatus for forming a tube into a serpentine configuration comprising a base, a first guide rail fixed to said base and extending longitudinally thereon, a second guide rail extending parallel with respect to said first guide rail and slidably mounted on said base to move along a line extending normally with respect to the longitudinally extending first guide rail, a plurality of first bend forming support blocks slidably mounted on said first guide rail, means for driving said first bend forming support blocks together and apart, means interconnecting the first bend forming support blocks for maintaining said support blocks with equal spacing therebetween as the support blocks are moved together and apart, second bend forming support blocks slidably mounted on said second guide rail, means for driving said second bend forming support blocks together and apart, means interconnecting the second bend forming support blocks for maintaining said second bend forming support blocks with equal spacing therebetween as the support blocks are moved together and apart, means for moving said second guide rail away from and towards said first guide rail and adjustable bend forming elements mounted on said support blocks, said adjustable bend forming elements including at least two different external surface configurations on each of said elements and means for rotating each of said surface configurations into an operative position.

* * * * *